United States Patent [19]

Traeger

[11] 4,434,782

[45] Mar. 6, 1984

[54] HEATING FURNACE

[76] Inventor: Joseph P. Traeger, 250 S. Oak, Mt. Angel, Oreg. 97362

[21] Appl. No.: 337,689

[22] Filed: Jan. 7, 1982

[51] Int. Cl.[3] ..... F24C 1/14

[52] U.S. Cl. ..... 126/77; 126/112; 126/116 C; 126/290

[58] Field of Search ..... 126/77, 112, 15 R, 15 A, 126/110 A, 110 AA, 99 A, 99 R, 116 C, 108, 126/103, 290

[56] References Cited

U.S. PATENT DOCUMENTS

| | | | |
|---|---|---|---|
| 511,194 | 12/1893 | Braddock | 126/112 |
| 561,408 | 6/1896 | Lynott | 126/77 |
| 646,863 | 4/1900 | McNaughton | 126/77 |
| 767,636 | 8/1904 | Dietz | 126/112 |
| 1,663,937 | 3/1928 | Ehrlich | 126/77 |
| 2,242,630 | 5/1941 | Stiengruber | 126/116 C |
| 2,345,519 | 3/1944 | Wingert | 126/77 |
| 2,448,891 | 9/1948 | Katz | 126/290 |
| 2,548,267 | 4/1951 | Leichtle | 126/290 |
| 4,154,212 | 5/1979 | Wilkinson | 126/290 |
| 4,319,556 | 3/1982 | Schwartz | 126/77 |

*Primary Examiner*—Daniel J. O'Connor
*Attorney, Agent, or Firm*—Kolisch, Hartwell & Dickinson

[57] ABSTRACT

A combination furnace including a solid fuel burning section and an electrically powered heating section. The two sections are disposed within an upright, insulated casing. A heat exchanger is provided above a fire box which constitutes the fuel-burning section. Dampers control the flow of combustion air to the fire box and the heat exchanger.

3 Claims, 3 Drawing Figures

HEATING FURNACE

BACKGROUND OF THE INVENTION

This invention relates to a furnace, and more particularly to a furnace which is usable in home heating.

The particular furnace described herein is a combination furnace, in that it includes an electric heating section and a solid fuel, i.e., wood burning section. The electrically powered heating section and the fuel burning section may be installed with individual remote thermostats controlling heat output. The thermostat for the wood burning section may be set at the desired room temperature, with the thermostat for the electrically powered heating section at the minimum desired room temperature, a few degrees lower. With this type of installation, the electrically powered heating section then serves as a backup for the wood or fuel burning section. The arrangement also makes it possible to actuate both the wood burning section and the electrically powered heating section at the same time, by simply turning both thermostats to settings above room temperature.

The furnace of the invention also features a construction wherein it may be mounted in a relatively confined space. As a consequence, the furnace is well adapted for mobile home installation, where, typically, space for mounting a furnace is limited. While well suited for mobile home installation, the furnace, of course, can be utilized for fulfilling other heating requirements.

A feature of the furnace of the invention is the provision of a fire box having metallic, i.e., heat conductive walls, which forms the solid fuel combustion chamber in the furnace. Combustion products pass upwardly from this combustion chamber and thence through a metallic heat exchanger disposed above the fire box. From the heat exchanger the combustion products pass upwardly through a flue which connects with the usual chimney, exhausting to the atmosphere. Damper means is provided, including a fire draft damper which controls the admission of fresh air to the fire box, and a balance draft damper controlling the admission of fresh air to the heat exchanger disposed above the fire box. The dampers work oppositely to each other, which is to say that when one is opened the other is closed. Further explaining, when the room thermostat calls for heat, the balance draft damper controlling air flow to the heat exchanger closes and the fire draft damper controlling air flow to the combustion chamber opens, to increase the burning rate of fuel in the fire box and the heat given off by the fire box and the heat exchanger thereabove. On a given limit temperature being reached, the fire draft damper closes and the balance draft damper opens, which has the effect of reducing the burning rate of the fuel and allowing cool air to circulate through the upper heat exchanger and out the flue. This rapidly drops the temperature of the heat exchanger, and also has the effect of flushing out creosote and other residuals which might contribute to a fire hazard in the flue system.

A blower, located adjacent the top of the furnace, when actuated, pulls air inwardly through a return air port located adjacent the top of the furnace, and forces such air downwardly through the furnace, first over an electrically powered heating section, and thence over the heat exchanger and fire box above-described. With no power delivered to the electrically powered heating section, such air is heated solely by the heat exchanger and the fire box. With fuel burning in the fire box, and with electric power delivered to the electrically powered heating section, such air is heated by both instrumentalities. The electrically powered heating section, heat exchanger and fire box are all mounted within an insulated, upstanding furnace casing functioning to channel air being heated downwardly through the furnace as such passes over the electrically powered heating section, heat exchanger and combustion chamber, finally to flow into a supply plenum for heated air located adjacent the base of the furnace.

Objects of the invention, therefore, include the provision of a practical, solid fuel burning and electrically powered combination furnace for home heating applications; the provision in a furnace, with solid fuel burning capability, of a fire box forming the combustion chamber connecting with a secondary heat exchanger, and damper means including a fire draft damper and a balance draft damper effective to control burning rate and heat exchanger temperature; the provision of a furnace with an insulated casing forming the exterior of the furnace, adapting it for mounting in a confined space; and the provision of a furnace with solid fuel burning and electrically powered capability which may be manufactured as a factory built unit, and is relatively easily installed.

These and other objects and advantages are attained by the invention, which will become more fully apparent from a reading of the following description, which is to be taken in conjunction with the accompanying drawings, wherein:

DETAILED DESCRIPTION OF A PREFERRED EMBODIMENT OF THE INVENTION

Figure 1:
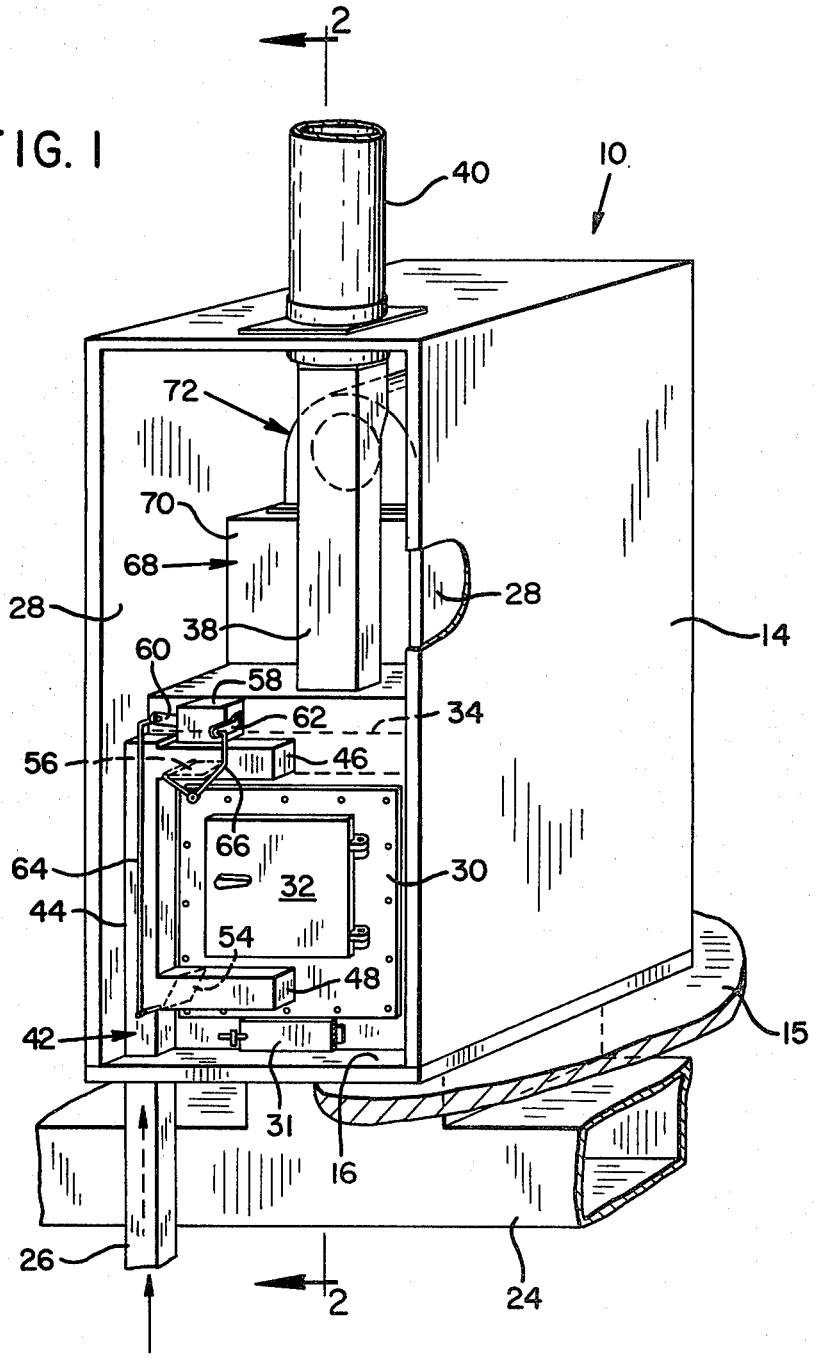
FIG. 1 is a perspective view looking at the front of the furnace, and with front panels removed to illustrate interior details.
Figure 2:
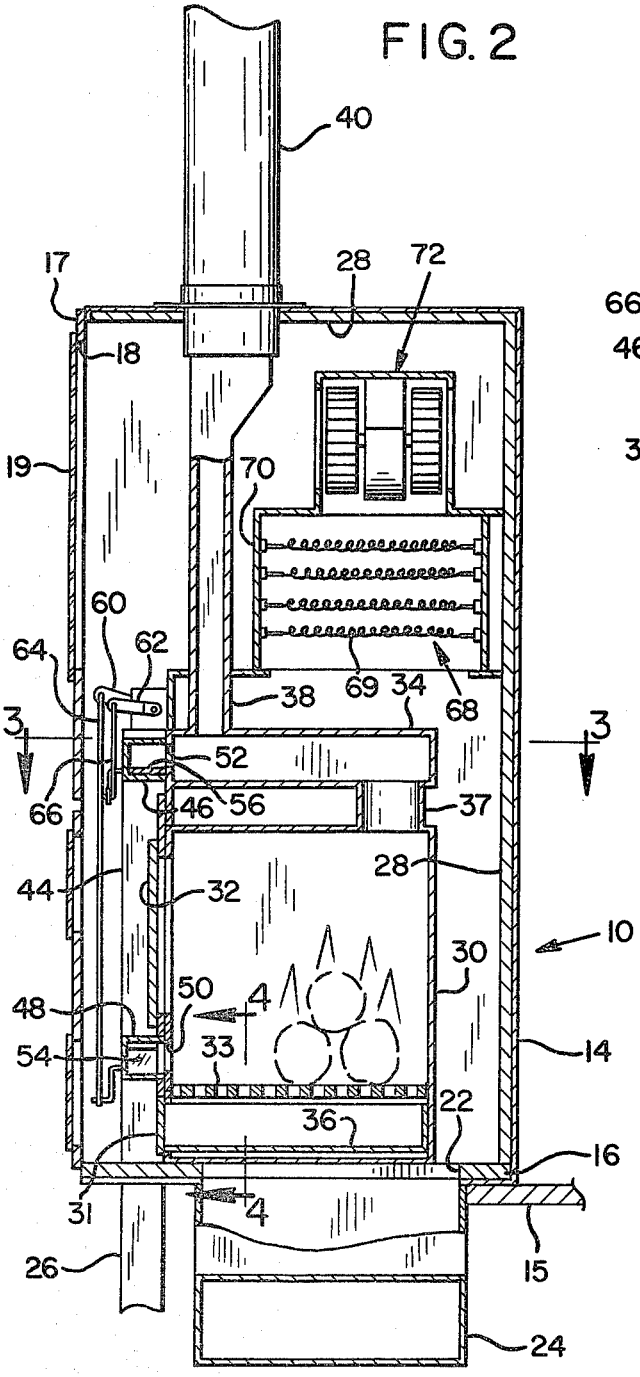
FIG. 2 is a cross-sectional view, taken generally along the line 2—2 in FIG. 1.
Figure 3:
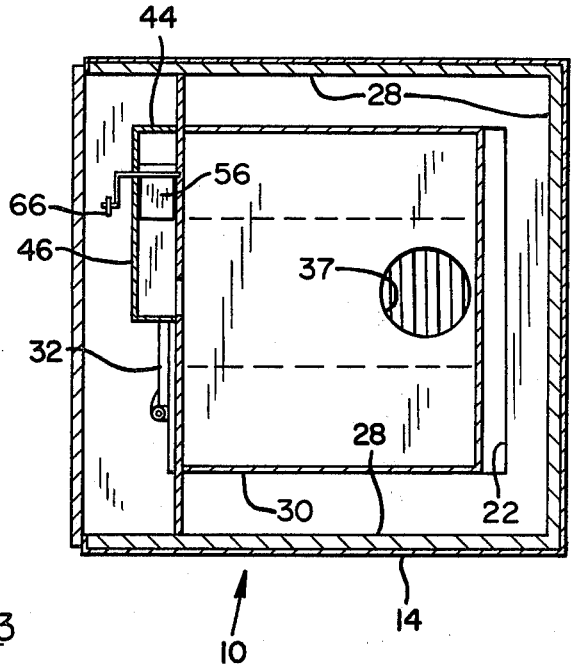
FIG. 3 is a cross-sectional view, taken generally along the line 3—3 in FIG. 2

Referring to the drawings, a furnace constructed according to a specific embodiment of this invention is illustrated generally at 10. The furnace shown is adapted to be mounted in the space usually provided in a mobile home for the provision of a conventional furnace, such as a closet space.

The furnace includes an upright, substantially rectangular casing 14 which is supported on floor 15 of the place where it is installed by non-combustible base 16. Frame panels 17, which may be hinged or removable, close off the front of the casing. Shown at 18, is a return air opening which may be provided with a trim grill 19 through which cool air from adjacent the top of the space being heated returns to the furnace for heating purposes. Air passing downwardly through the furnace and heated by such passage travels downwardly through the base of the furnace, through opening 22, into a heated air supply plenum 24 from which the air is channeled to the desired locations in the space being heated. Outside air to support combustion, referred to as "combustion air", enters the furnace through combustion air inlet 26.

Casing 14 over the interior thereof is completely insulated, as with one-inch thick, foil backed, fiberglass duct board 28. This insulation enables the furnace to be mounted in a relatively confined space with minimal clearance between the outside of the casing and the walls of the space.

Mounted within the furnace casing adjacent the base thereof and on the non-combustible base is a fire box 30. The firebox, which defines within it a combustion chamber for fuel, is substantially rectangular in shape, with sides, top and back in thermal communication with air moving downwardly through the interior of the furnace. A hinged fire box door 32, when opened, exposes an opening for the introduction of solid fuel into the fire box.

Interior of details of the fire box are more or less conventional. Such may include the usual cast iron grate 33 spaced above an ash pit adjacent the bottom of the fire box. If desired, a metal drawer 36 may be provided in the ash pit below the grate as a convenient method for removing ash accumulation. Door 31, when opened, exposes an opening providing access to the ash pit. The fire box (and internal structure) being made of metal, has heat conductive walls, and thus functions as a heat exchanger, exchanging heat from the fuel combusting within the combustion chamber defined by the box to air travelling over the exterior of the fire box.

Disposed above the fire box, and suitably supported in spaced relation over the top of the box, is a heat exchanger 34 of substantially rectangular configuration. The heat exchanger has metallic side, top and bottom walls defining an enclosed space within the exchanger. A fire box collar 37 connects an opening in the top of the fire box with another opening in the bottom of the heat exchanger. In this way, gaseous and gas-borne combustion products produced with burning of fuel in the fire box travel upwardly from the fire box into the heat exchanger.

Connecting with an opening in the top of the heat exchanger, adjacent the other end of the exchanger from collar 36, is a flue 38. Such extends upwardly in the furnace past the return air opening 18 to a connection with a chimney 40. The chimney, although such is not shown, extends in the usual manner to an elevated position above the roof of the mobile home. The flue and chimney provide a passage for gaseous combustion products leaving the heat exchanger upwardly through the furnace and thence to the exterior of the home whence such products are expelled to the atmosphere.

Combustion air inlet 26 connects with a duct system 42. Such includes an upstanding leg 44, and connecting with this upstanding leg, laterally outwardly projecting legs 46, 48. Lower leg 48 connects through an opening 50 to the interior of the fire box. Upper leg 46 connects to an opening 52 with the interior of the manifold.

Controlling air flow from leg 44 into leg 48 is a fire draft damper 54. Controlling flow of air from leg 44 into leg 46 is a balance draft damper 56. Each damper comprises a plate, which in an upstanding position closes off the leg with which the damper is associated. The plate is pivotable about its lower margin to a horizontal position, wherein the leg with which the damper is associated is fully open.

A damper motor housed within a housing is shown at 58, having an output shaft means connected to a pair of arms 60, 62, such arms being link-connected through links 64, 66 to the fire draft damper and balance draft dampers, respectively. With movement of the arms upwardly in FIG. 1, the balance draft damper, which is shown in an open position, swings to a closed position, and the fire draft damper, which is shown in a closed position, swings to an open position. Return movement of the arms by movement downwardly returns the dampers to the positions shown. In this way, the two dampers are oppositely connected, with one moving to an open position while the other moves to a closed position, and visa versa.

Indicated generally at 68, and disposed above heat exchanger 34, is an electrically powered heating section. This may include the usual electrical coils 69 housed within a housing 70 which defines a path for moving air downwardly over the coils and thence out the base of the section onto heat exchanger 34. Such movement of air is produced through actuation of a blower generally shown at 72, which may include the usual electrically driven squirrel cage blower, operable to pull air inwardly through the inlets thereof and thence to force such air downwardly through heating section 68.

The damper motor may be provided with a spring-based mechanism operable to move the fire draft damper to a closed position and the balance draft damper to an open position with de-energizing of the motor occurring as a result of power failure. The electrically powered heating section and the solid fuel burning section may be controlled, as by a pair of thermostats, one of which may control the fuel burning section, and the other of which may control the electrically powered heating section. Normally, the thermostat for the fuel burning section is set at the desired room temperature, and the thermostat for the electrically powered heating section is set at the minimum desired room temperature, a few degrees lower. In this way, the electric section then serves as a backup for the wood section.

A control means operated by the thermostats is selected whereby when the remote thermostat for the solid fuel-burning section calls for heat, the damper motor is energized and opens up the fire draft damper, and closes the balance damper. This causes outside combustion air to be admitted to the fuel burning section and shuts off the flow of such air through the upper heat exchanger. When the temperature in the area surrounding the heat exchanger reaches a setting in the control system set for causing the fan or blower to come on, such as 140° F., the blower is activated, and air is caused to be circulated downwardly in the furnace over the fuel burning section to be delivered to supply plenum 24. On the remote thermostat controlling the wood section being satisfied, a signal is produced causing the damper motor to de-energize, which returns the fire draft control to the closed position and opens up the balance draft damper. This reduces burning rate of the fuel in the combustion chamber and allows cool air to circulate through the upper heat exchanger and out the flue, which rapidly drops the temperature in heat exchanger 34. The fan continues to run until a lower setting in the control means is reached, normally about 90° F.

When the temperature in the area surrounding heat exchanger 34 reaches an upper maximum, for instance, 175° F., the fan limit control closes the fire draft damper and opens the balance draft damper, even if the remote thermostat is calling for heat. The fire draft damper will stay closed until the heat exchanger area temperature drops below 175° F. The fan will continue to run to induce cooling temperature.

The furnace may also be equipped with an auxiliary temperature limit switch located in the fan compartment, which de-energizes the damper motor causing the fire draft damper to close and the balance damper to open if the fan compartment temperature reaches a certain level, for instance, 160° F. Excessive temperatures in the fan compartment indicate a fan motor failure, fan limit control failure, or a restricted duct.

If it is desired to actuate both the fuel burning section and the electrically powered heating section at the same time, this is accomplished by simply turning both thermostats up above room temperature.

While a specific control system for the furnace has been described, obviously variations in the control system are possible. Whatever the control system is utilized, the furnace has the flexibility, as the result of including both a fuel burning section and an electrically powered heating section, to supply the heating demands of the user using wood if such is available, both electricity and wood under extreme conditions, and using the electrically operated heating section, exclusively, at such times as when the fuel burning section is not operable.

The insulated furnace casing confines the air moving downwardly through the unit during heating. Temperatures on outer wall surfaces of the furnace are maintained low enough to enable the furnace to be installed in a confined space, with minimal clearance between the furnace and outstanding walls.

While a particular embodiment of the invention has been described, it should be obvious that variations and modifications are possible without departing from the invention.

It is claimed and desired to secure by Letters Patent:

1. A furnace comprising:

an upstanding casing, a combustion chamber mounted within and adjacent the base of the casing, a heat exchanger disposed over said combustion chamber and a duct connecting the combustion chamber and the heat exchanger, a flue connecting with the exchanger extending out of the casing, insulation on the inside of the casing surrounding the combustion chamber and heat exchanger, a fresh air supply duct for supplying combustion air extending into the base of the casing, a first duct connection connecting the fresh air supply duct and the combustion chamber whereby combustion air is supplied the combustion chamber, a second duct connection connecting the fresh air supply duct and the heat exchanger, a first damper for said first duct connection and a second damper for said second duct connection, and damper control means for effectuating opening of said first damper with closing of the second and closing of the first damper with opening of the second.

2. The furnace of claim 1, wherein the damper control means comprises a damper motor, including output shaft means, and linkage means connecting the output shaft means of said damper motor and said first and second dampers, whereby with actuation of said motor to produce closing of said first damper, the second damper opens, and with actuation of said motor to produce opening of said first damper the second damper closes.

3. The furnace of claim 2, which further comprises a return-air opening in said casing adjacent the top thereof, blower means adjacent the top of the casing constructed and arranged to pull air inwardly into said casing through said return-air opening and thence force such downwardly through said casing over said heat exchanger and said combustion chamber, and an electrically powered heating section mounted within said casing spaced above said heat exchanger and below said blower means, whereby air passing from said blower means moves through said electrically powered heating section on travelling toward said heat exchanger.

* * * * *